US005988584A

United States Patent [19]

Perry

[11] Patent Number: 5,988,584

[45] Date of Patent: Nov. 23, 1999

[54] SECURITY ANCHOR

[76] Inventor: Robert C. Perry, 5755 SW. Willow La., Lake Oswego, Oreg. 97035-5340

[21] Appl. No.: 08/213,933

[22] Filed: Mar. 16, 1994

[51] Int. Cl.[6] ..... E05B 73/00

[52] U.S. Cl. ..... 248/551

[58] Field of Search ..... 248/551–553, 248/499; 70/58, 18, 233, 30, 49; 292/307 R, 320, 325

[56] References Cited

U.S. PATENT DOCUMENTS

| | | | |
|---|---|---|---|
| 3,848,943 | 11/1974 | Geesaman | 206/373 |
| 4,326,741 | 4/1982 | Wilson | 292/307 R |
| 4,342,477 | 8/1982 | McClure . | |
| 4,662,035 | 5/1987 | Hatfield . | |
| 4,733,840 | 3/1988 | D'Amore . | |
| 4,811,844 | 3/1989 | Moulding, Jr. | 292/307 X |
| 4,979,382 | 12/1990 | Perry | 248/553 X |
| 5,033,904 | 7/1991 | Challis | 403/265 X |
| 5,050,836 | 9/1991 | Makous . | |
| 5,076,079 | 12/1991 | Monoson | 70/58 |
| 5,184,798 | 2/1993 | Wilson . | |
| 5,197,706 | 3/1993 | Braithwaite | 70/58 X |

FOREIGN PATENT DOCUMENTS

| | | | |
|---|---|---|---|
| 1023017 | 3/1953 | France | 292/307 R |

*Primary Examiner*—Alvin Chin-Shue
*Attorney, Agent, or Firm*—Smith-Hill and Bedell

[57] ABSTRACT

A security anchor comprises a flexible cable having an end segment of predetermined thickness, and an attachment plate having a generally flat surface with at least one channel formed therein. The channel is sized to receive the end segment of the cable. The end segment of the flexible cable is secured in the channel by adhesively bonding the cable to the attachment plate.

24 Claims, 1 Drawing Sheet

SECURITY ANCHOR

BACKGROUND OF THE INVENTION

This invention relates to a security anchor.

In retail stores that sell electronic equipment, it is usual for the hand-held remote control unit of a display model to be attached to the main unit, such as a TV set or video cassette recorder, by means of a cable that is molded at its two opposite ends into two attachment buttons respectively, the buttons being attached one to the remote control unit and the other to the main unit. The buttons are attached to the respective units by double-sided adhesive tape, which does not hold the buttons very securely, and therefore it is easy for an unauthorized person to remove the remote control unit. Moreover, the surface of the button that is provided with the double-sided adhesive tape is flat, and therefore if it is necessary to attach the button to a curved surface, particularly a surface that is curved about two axes, because the remote control unit or main unit does not have a convenient flat surface, the attachment is even less secure. Further, the cables that are normally used for connecting the buttons are rather thin and can be cut quite readily without drawing attention of store personnel.

Various types of security anchors have been proposed for securing electronic equipment against theft, but generally they are not well suited for use in securing small articles such as remote control units. For example, some known security anchors are rather bulky, because the poor adhesion requires that the anchor be in contact with the article to be secured over quite a large area, and others require that holes be drilled in the article to be secured.

Some known security anchors designed for securing a remote control unit or other small article employ a coiled cable, which may be inconvenient to the user since it is necessary to apply force to uncoil the cable and hold the remote control unit in a desired orientation.

Sometimes it is desirable to be able to secure an article in readily releasable fashion, for example by means of a padlock. Security devices of the kind currently employed for securing remote control units in retail stores are not suitable for this purpose because they do not have an eye through which the padlock shackle can be inserted.

Other known security anchors, including some manufactured by SECURTECH CO. of Lake Oswego, Oreg., include a cable with an eye at one end, but such an eye is of limited utility in that the eye cannot be attached directly to an article to be secured or to a mechanical ground.

SUMMARY OF THE INVENTION

In accordance with a first aspect of the present invention there is provided a security anchor comprising a flexible cable having a first end segment of predetermined thickness, an attachment plate having a generally flat surface with at least one channel formed therein, the channel being sized to receive the first end segment of the cable, whereby the first end segment of the cable can be placed in the channel, and an adhesive means for securing said first end segment of the flexible cable in the channel by adhesively bonding the cable to the attachment plate.

In accordance with a second aspect of the present invention there is provided a kit for assembling a security anchor, said kit comprising first and second lengths of flexible cable of different respective thicknesses, an attachment plate having a generally flat surface with first and second channels formed therein, the channels being sized to receive end segments of the first and second cables respectively, whereby either cable can be selected and the end segment of the selected cable can be placed in an appropriate channel, and adhesive for securing the end segment of the selected cable in the appropriate channel by adhesively bonding the cable to the attachment plate.

In accordance with a third aspect of the present invention there is provided a method of manufacturing a security anchor, comprising providing a first length of flexible cable of a first predetermined thickness and having a first end segment, providing a second length of flexible cable of a second predetermined thickness, greater than said first predetermined thickness and having a first end segment, providing an attachment plate having a generally flat surface with first and second channels formed therein, the width of the first channel being slightly greater than the thickness of the first cable and the width of the second channel being slightly greater than the thickness of the second cable, selecting one of the first and second cables, placing the first end segment of the selected cable in the channel of which the width is slightly greater than the thickness of the selected cable, and adhesively bonding the first end segment of the selected cable to the attachment plate.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION

Figure 1:
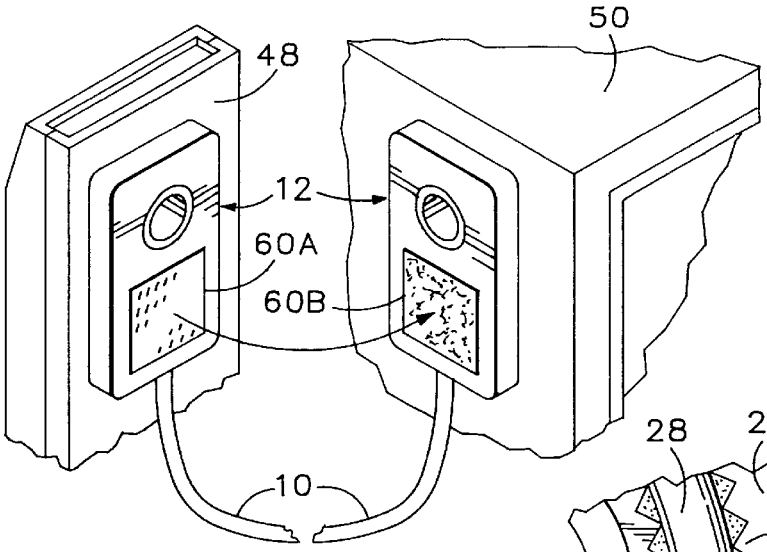
FIG. 1 is a general view showing use of a security anchor embodying the present invention for securing a television remote control unit to a TV set.
Figure 4A:
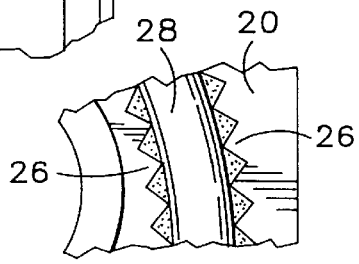
FIG. 4A is a detail of FIG. 4.

The security anchor that is shown in the drawings comprises a length 10 of cable having a tight bonded sleeve. Such a cable has a core made of wire strands and a sleeve or jacket of synthetic polymer material tightly bonded to the core. Suitable cable is sold in various diameters by West Coast Wire Rope of Portland, Oreg. Alternatively, the metal cable core may be obtained from West Coast Wire Rope and the sleeve may be applied by Coaxco Inc. of Tualatin, Oreg.

Figure 2:
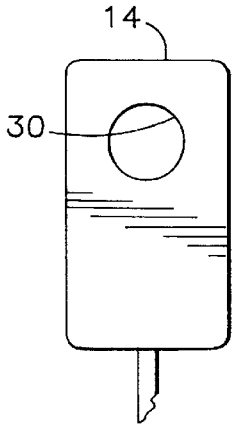
FIG. 2 is a front elevation of an attachment plate that forms part of the security anchor.
Figure 3:
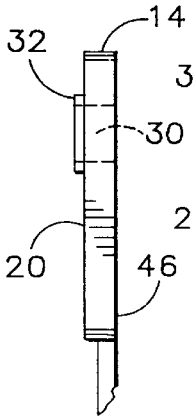
FIG. 3 is a side elevation of the attachment plate that is shown in FIG. 2.
Figure 4:
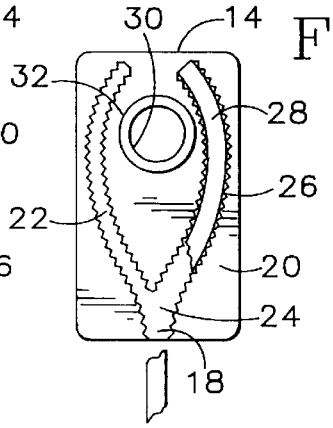
FIG. 4 is a rear elevation of the attachment plate that is shown in FIG. 2.
Figure 5:
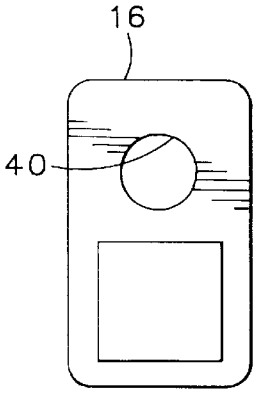
FIG. 5 is a front elevation of a cover plate that can be attached to the attachment plate shown in FIGS. 2 and 3.
Figure 6:
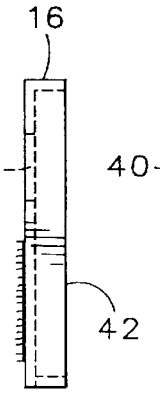
FIG. 6 is a side elevation of the cover plate shown in FIG. 5.
Figure 7:
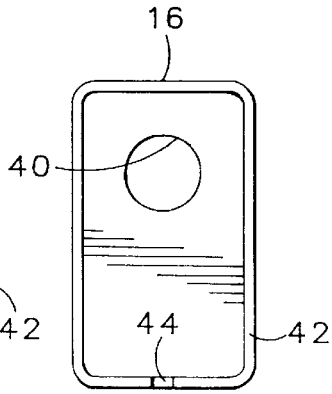
FIG. 7 is a rear elevation of the cover plate.

The anchor also comprises two attachment pads 12, each of which comprises a base plate 14 (FIGS. 2–4) and a cover plate 16 (FIGS. 5–7). The base plate 14 is molded from high-impact plastic, such as glass-filled ABS, and is generally rectangular in form. The base plate is formed at one main face 20 with an entry or neck channel 18 and two branch channels 22,24 that diverge from the entry channel 18. The entry channel 18 is sized to receive cable that is ⅛ inch in diameter whereas the two branch channels are of different width, with the narrower channel 22 being sized to receive a length of cable having a 1/16 inch diameter core and coated to a diameter of 3/32 inch and the wider channel 24 sized to receive a length of cable having a 3/32 inch diameter core and coated to a diameter of 1/8 inch. The depth of each channel is such that when a length segment of the appropriate diameter cable is placed in the channel, the cable does not protrude out of the channel in the direction perpendicular to the main face 20 of the plate.

The base plate 14 is formed with triangular section teeth 26 at the two confronting walls of each channel. It is preferred that the maximum width of the channel 24, for receiving the thicker cable, be about 0.182 inch and the minimum distance between the tips of the teeth 26 in that channel be about 0.120 inch, and that the corresponding dimensions of the channel 22, for the thinner cable, be 0.115 inch and 0.093 inch respectively.

It will be seen that the two channels 22,24 are placed to opposite sides respectively of a center line of the base plate 14, and the path of one channel is substantially a mirror image of the path of the other. The overall path of each channel is substantially in the shape of an elongated, sloping letter S, having two connected segments of opposite curvature.

Opposite end segments 28 of the length 10 of cable are placed in the appropriate channels of the two base plates respectively and adhesive is placed on top of the cable. The teeth 26 in the channels allow a fairly wide tolerance on the cable thickness, since the tips of the teeth can press into the relatively soft material of the cable jacket if necessary. A suitable adhesive is the cyano acrylate adhesive sold by SECURTECH CO. of Lake Oswego, Oreg. under the designation RIGHTON Close Bond Adhesive. This adhesive has a low viscosity in the uncured state and seeps under the cable end segment 28 by way of the spaces between the teeth 26. In the cured state, the adhesive bonds the cable end segments firmly in the respective channels.

The base plate 14 is formed with a circular hole 30 between the paths of the two channels 22 and 24, and an annular land 32 projects from the face 20 around the periphery of the hole 30. The cover plate 16, which is also formed with a hole 40, is attached to the base plate by applying adhesive to the front face of the base plate and then applying the cover plate 16 over the front surface 20 of the base plate, so that the holes in the cover plate and base plate are in registration, and the land 32 of the base plate fits in the hole 40 of the cover plate. A suitable adhesive is the cyano acrylate adhesive mentioned above. In fact, the bonding of the cable to the base plate and the bonding of the cover plate to the base plate may be accomplished simultaneously. The cover plate has a peripheral flange 42, which is formed with a notch 44 for receiving the cable. Entry of the annular land 32 in the hole 40 limits escape of adhesive from between the plates.

In order to use the security anchor shown in the drawings for attaching a remote control unit to a television set, adhesive is applied to the back face 46 of each base plate 14, and one attachment pad is applied to the remote control unit 48 and the other is applied to the TV set 50. If the cyano acrylate adhesive mentioned above is used, the pads are permanently attached to the remote control unit 48 and the TV set 50 by respective layers of adhesive (not shown). Thus, the remote control unit is securely attached to the television set. The attachment pad cannot be readily removed from the remote control unit or from the television set, and the cable cannot readily be cut without use of special tools and running the risk of catching the attention of store personnel. The flange 42 prevents insertion of a prying tool between the base plate 14 and the cover plate 16. If the television set and remote control unit are sold, the cable can be cut adjacent each attachment plate. No significant amount of cable projects from the attachment pad, and the attachment pad itself is unobtrusive.

In the event that the television set, for example, does not have a suitable planar surface for receiving the attachment pad, it is preferable to use a silicone rubber adhesive, such as the adhesive sold by General Electric through its Industrial Plastic Adhesive division under the designation RTV 6808, since this type of adhesive accommodates variation in spacing between the attachment pad and a curved surface of the television set. Further, although the silicone rubber adhesive provides an adequate attachment for many purposes, it does not provide as secure a bond as the cyano acrylate adhesive and is suitable for use when temporary attachment is sufficient or desired. Therefore, if is not acceptable to cut the cable and leave the attachment pads secured to the remote control unit and main unit when sold, the attachment pads are preferably secured using the silicone rubber adhesive.

Figure 8:
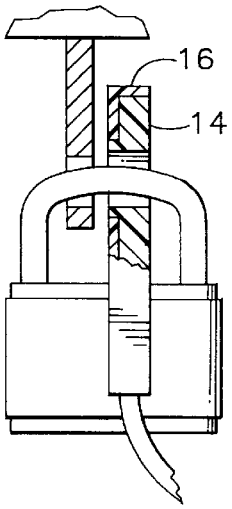
FIG. 8 is a partial view illustrating use of a padlock to attach the security anchor to a mechanical ground.

The holes 30 and 40 in the base plate and the cover plate respectively allow use of the security anchor in conjunction with a padlock. As shown in FIG. 8, the shackle of a padlock may be inserted through the holes 30,40 and a suitable eyehole in an attachment member for attachment of the security anchor to a mechanical ground. Since the attachment pad is quite slim, several attachment pads, of different respective security anchors, can be attached to a mechanical ground using a single padlock. This feature allows the remote control unit to be secured without attaching it to the main unit. For example, the remote control unit can be attached to a mechanical ground at a location close to the main unit that is to be controlled, particularly when the remote control unit is a general purpose unit and is not restricted in use to any specific main unit. This avoids the need for the retailer to unpack a remote control unit for each main unit and risk loss of remote control units. Further, a single remote control unit can be used in conjunction with several main units.

The illustrated security anchor is not restricted in its application to use with combinations of remote control unit and main unit and may be used in conjunction with stand alone units also. Due to its small size, the security anchor is well suited for securing small devices, such as calculators and electronic dictionaries, against theft without impairing their usefulness. For example, a school's inventory of hand held calculators may be equipped with security anchors having short cables which do not interfere with use but nevertheless allow the calculators to be attached securely to a mechanical ground when not in use.

The ease of assembly of the security anchor renders it particularly well suited for sale in kit form. This allows the user to adapt the length of cable to the particular application and not be restricted to a limited range of cable lengths.

The S-shaped configuration of the channel 24, for example, ensures that when the thicker cable is properly placed in the channel and is bonded to the base plate 14, and tension is applied to the cable in the direction of the arrow in FIG. 4, removal of the cable is resisted not only by the shear strength of the adhesive but also by a frictional force created at each bend in the channel. In this manner, the cable is held more securely than if the cable were straight.

Moreover, when tension is applied to the cable in the direction of the arrow in FIG. 4, the teeth 26 dig into the jacket of the cable and resist movement of the cable lengthwise of the channel. Also, the adhesive bonded to the cable forms complementary wedge shaped adhesive bodies between the teeth and the exterior surface of the cable, and lengthwise movement of the cable can be caused only by breaking the adhesive bond between the bodies and the jacket of the cable.

Use of the narrower channel 22 instead of the wider channel 24 provides for a more secure bond in the event that the thinner cable is selected, since it is desirable that the layer of adhesive between the surface of the cable and the surface bounding the channel be quite thin.

The outer faces 44 of the two cover plates 16 may be provided with respective components 60A, 60B of a strip of hook-and-loop fastener, such as the material sold under the trademark VELCRO. This allows the remote control unit to be releasably attached to the main unit when not in use, as indicated by the arrow in FIG. 1.

The security anchor shown in the drawings is well suited to applications in which the length of cable is not predictable, since the user can assemble an anchor when required for a particular purpose and cut the cable to any desired length.

The remote control or other secured device can be used freely, within the constraint of the length of the cable, without being subject to a distracting return force as is the case with some devices that employ a retractable cable.

It will be appreciated that the invention is not restricted to the particular embodiment that has been described, and that variations may be made therein without departing from the scope of the invention as defined in the appended claims and equivalents thereof. For example, it will be appreciated that it is not necessary to all embodiments of the invention that use of a padlock be accommodated, and accordingly the hole in the attachment pad is optional. In a modification of the attachment pad, there is no cover plate. In this case, it is preferred that the attachment pad be secured to the remote control unit, for example, by a layer of adhesive between the face 20 and the remote control unit, so that the channels 22 and 24 face the remote control unit. This effectively prevents a casual thief from detaching the remote control unit from the cable by progressively lifting the cable from the channel 22 or 24 (perpendicular to the plane of FIG. 4) while leaving the attachment pad secured to the remote control unit. In some applications, such as securing a telephone in a store display, it might be desirable for the attachment pad at one end of the cable to be without a hole for securing to the telephone instrument using a silicon rubber adhesive and for the pad at the opposite end of the cable to be formed with a hole for attachment to a mechanical ground by means of a padlock.

I claim:

1. A security anchor for attachment to an article that is to be secured against unauthorized removal and has a substantially flat surface, said security anchor comprising:

an attachment plate having a generally flat front surface with at least one elongate channel formed therein, the channel being open at the generally flat front surface of the attachment plate over substantially the entire length of the channel, and the attachment plate also having a substantially flat back surface, whereby the attachment plate can be attached to the article by adhesive bonding with the substantially flat back surface of the attachment plate in face-to-face confronting relationship with the substantially flat surface of the article, a flexible cable having a first end segment located in the channel of the attachment plate, and an adhesive means securing said first end segment of the flexible cable in the channel by bonding to the cable and the attachment plate.

2. A security anchor according to claim 1, wherein the attachment plate is formed with a hole that is spaced from the channel and the anchor further comprises a cover plate that is attached to the attachment plate and is formed with a hole that is in registration with the hole in the attachment plate, whereby a padlock shackle can be inserted through the two holes without obstruction by the cable.

3. A security anchor according to claim 1, comprising a second attachment plate having a generally flat surface with at least one channel formed therein, the channel being sized to receive an opposite end segment of the cable, whereby the opposite end segment of the cable can be placed in the channel, and said adhesive means can secure said second end segment of the flexible cable in the channel of the second attachment plate by bonding to the cable and the second attachment plate.

4. A security anchor according to claim 1, wherein the channel is composed of two connected segments of opposite curvature.

5. A security anchor according to claim 1, wherein the attachment plate has a second channel formed therein, the second channel being sized to receive an end segment of a flexible cable that is of different diameter from said first end segment of the first flexible cable.

6. A security anchor according to claim 5, wherein the second channel is substantially a mirror image of said one channel.

7. A security anchor according to claim 1, further comprising a cover plate that is attached to the attachment plate at the front surface thereof and covers the channel.

8. A security anchor according to claim 7, wherein the attachment plate has a peripheral surface that joins the back surface and the front surface thereof and the cover plate has a flange that extends over the peripheral surface of the attachment plate.

9. A security anchor according to claim 1, wherein the flexible cable has a metal core and a jacket of synthetic polymer material, the channel in the attachment plate is curved, and the attachment plate includes projections that extend into the channel and have tips that dig into the jacket when tension is applied to the cable.

10. A security anchor according to claim 1, wherein the attachment plate includes projections that extend into the channel, whereby interference between the projections and the adhesive means bonded to the cable resists removal of the cable from the channel.

11. A security anchor according to claim 5, wherein the second channel is slightly wider than the first channel, the attachment plate has a peripheral surface that joins the back surface and the front surface of the plate and the second channel includes a neck portion that is open at the peripheral surface of the attachment plate and the first channel branches from the neck portion of the second channel.

12. A kit for assembling a security anchor, said kit comprising:

first and second lengths of flexible cable of different respective thicknesses, an attachment plate having a generally flat surface with first and second elongate channels formed therein, each channel being open at the generally flat surface of the attachment plate over substantially the entire length of the channel and the channels being of first and second different widths respectively, for receiving end segments of the first and second cables respectively, whereby either cable can be selected and the end segment of the selected cable can be placed in an appropriate channel, and adhesive for securing the end segment of the selected cable in the appropriate channel by adhesively bonding the cable to the attachment plate.

13. A kit according to claim 12, wherein the attachment plate is formed with a hole that is spaced from the channels and the kit further comprises a cover plate for attachment to the attachment plate, the cover plate having a hole that is in registration with the hole in the attachment plate when the two plates are secured together, whereby a padlock shackle can be inserted through the two holes without obstruction by the selected cable.

14. A kit according to claim 12, comprising a second attachment plate having a generally flat surface with at least one channel formed therein, the channel being sized to receive an opposite end segment of the selected cable, whereby the opposite end segment of the selected cable can be placed in the channel, and said adhesive can secure said second end segment of the selected cable in the channel of the second attachment plate by adhesively bonding the selected cable to the second attachment plate.

15. A kit according to claim 12, wherein the channel is composed of two connected segments of opposite curvature.

16. A kit according to claim 12, wherein the second channel is substantially a mirror image of said one channel.

17. A kit according to claim 12, further comprising a cover plate that for attachment to the attachment plate at the front surface thereof and covering the channels.

18. A kit according to claim 17, wherein the attachment plate has a substantially flat back surface and a peripheral surface that joins the back surface and the front surface of the attachment plate and the cover plate has a flange that extends over the peripheral surface of the attachment plate.

19. A kit according to claim 12, wherein each length of flexible cable comprises a metal core and a jacket of synthetic polymer material, the channels in the attachment plate are curved, and the attachment plate includes projections that extend into each channel and have tips that dig into the jacket of the selected cable when tension is applied to the cable.

20. A kit according to claim 12, wherein the second channel is slightly wider than the first channel, the attachment plate has a peripheral surface that joins the back surface and the front surface of the plate and the second channel includes a neck portion that is open at the peripheral surface of the attachment plate and the first channel branches from the neck portion of the second channel.

21. A method of manufacturing a security anchor, comprising:

providing a first length of flexible cable of a first predetermined thickness and having a first end segment, providing a second length of flexible cable of a second predetermined thickness, greater than said first predetermined thickness and having a first end segment, providing an attachment plate having a generally flat front surface with first and second elongate channels formed therein, each channel being open at said generally flat front surface over substantially the entire length of the channel and the width of the first channel being slightly greater than the thickness of the first cable and the width of the second channel being slightly greater than the thickness of the second cable, selecting one of the first and second cables, placing the first end segment of the selected cable in the channel of which the width is slightly greater than the thickness of the selected cable, and adhesively bonding the first end segment of the selected cable to the attachment plate.

22. A method according to claim 21, wherein each of the first and second lengths of flexible cable has a second end segment, opposite the first end segment, and the method further comprises:

providing a second attachment plate having a generally flat surface with first and second channels formed therein, the width of the first channel being slightly greater than the thickness of the first cable and the width of the second channel being slightly greater than the thickness of the second cable, and placing the second end segment of the selected cable in the channel of the second attachment plate of which the width is slightly greater than the thickness of the selected cable, and adhesively bonding the second end segment of the selected cable to the second attachment plate.

23. A method according to claim 21, wherein the attachment plate has a substantially flat back surface and a peripheral surface that joins the back surface and the front surface of the plate and the method further comprises providing a cover plate and attaching the cover plate to the attachment plate at said generally flat front surface, the cover plate covering the channels formed in the generally flat surface of the attachment plate and having a flange that extends over the peripheral surface of the attachment plate.

24. A method according to claim 21, wherein the attachment plate has a substantially flat back surface and a peripheral surface that joins the back surface and the front surface of the plate and the second channel includes a neck portion that is open at the peripheral surface of the attachment plate and the first channel branches from the neck portion of the second channel.

* * * * *